United States Patent [19]

Ray et al.

[11] Patent Number: 4,545,688

[45] Date of Patent: Oct. 8, 1985

[54] WATCH CASE HAVING SYNTHETIC MATERIAL SEALS BETWEEN DETACHABLE PARTS THEREOF

[75] Inventors: Claude Ray, La Chaux-de-Fonds; Walter Schaeren, Bienne, both of Switzerland

[73] Assignee: Asuag-SSIH, Neuchatel, Switzerland

[21] Appl. No.: 563,807

[22] Filed: Dec. 21, 1983

[30] Foreign Application Priority Data

Jan. 10, 1983 [CH] Switzerland ..... 110/83

[51] Int. Cl.[4] ..... G04B 37/00

[52] U.S. Cl. ..... 368/291; 368/294; 368/289; 368/287

[58] Field of Search ..... 368/294–296, 368/297, 309, 287, 291

[56] References Cited

U.S. PATENT DOCUMENTS

| | | | |
|---|---|---|---|
| 3,479,771 | 11/1969 | Steimann | 368/291 |
| 3,643,424 | 2/1972 | Simon | 368/291 |

FOREIGN PATENT DOCUMENTS

| | | | |
|---|---|---|---|
| 447373 | 3/1948 | Canada | 368/291 |
| 2836704 | 1/1979 | Fed. Rep. of Germany | 368/291 |
| 72292 | 5/1916 | Switzerland | 368/297 |
| 376436 | 12/1963 | Switzerland | 368/295 |
| 618312 | 7/1980 | Switzerland | 368/309 |
| 721920 | 1/1955 | United Kingdom | 368/287 |

*Primary Examiner*—Bernard Roskoski
*Attorney, Agent, or Firm*—Peter L. Berger

[57] ABSTRACT

The watch case comprising a middle (2) containing a lining (4) and a back (9) detachably mounted in a lower opening of the middle by means of a pressure device. A band (12) of synthetic material constituting a seal is formed on the periphery of the opening, that band being made in one piece with the lining and connected to it by portions of synthetic material crossing appropriate passages (15) of the middle. The side walls (16) of the opening are at least partially devoid of lining and they work together with opposite surfaces (17) of the back in order to assure pressure coupling of the latter and compression of the band (12).

6 Claims, 5 Drawing Figures

WATCH CASE HAVING SYNTHETIC MATERIAL SEALS BETWEEN DETACHABLE PARTS THEREOF

BACKGROUND OF THE INVENTION

This invention concerns a watch case comprising a middle containing a lining of synthetic material and at least one part detachably mounted in the opening of the middle by means of a pressure device, as well as a process to manufacture such watch case.

Swiss Pat. No. 616,808, as well as Swiss patent application No. 632,890 G, describe watch cases, the middle of which is lined with a synthetic material, e.g., by a molding process, and which are equipped with a bezel or a detachable back capable of being set in place under the effect of simple pressure. The value of these designs lies in simultaneously sealing the middle at all of its opening, notably, also at the passage of the control stem, and also to assure the elastic suspension of the movement. However, in these known watch cases sealing of the opening provided for the bezel or the back could be accomplished only by radial compression of the lining flush around the opening or its deformation by a hook-shaped skirt provided on the periphery of the bezel or back. To guarantee perfect tightness, it has proven necessary to provide sufficient depth of engagement of the bezel or back inside the middle, which is not always compatible with the dimensions of the extra-flat watch parts known at present. Furthermore, the axial retention of the bezel or of the back and the compression they exert on the seal are not as good as for the standard cases, where, for example, the outer surface of a skirt of the back or of the bezel comes in contact with an inclined metal surface of the middle.

SUMMARY OF THE INVENTION

This invention is for a watch case of the type mentioned, in which, however, the pressure coupling of the back and of the bezel or of another detachable part is accomplished by a metal-metal contact of a standard type, but in which the tightness, in spite of everything, remains assured by a synthetic lining provided inside the middle.

Another object of the invention is to provide a process to manufacture such watch case.

Other objects, advantages and features of this invention will become more apparent hereinafter.

BRIEF DESCRIPTION OF THE DRAWING

The invention will be clearly understood by reading the following description, given with reference to the attached drawings, among which.

DETAILED DESCRIPTION

Figure 1:
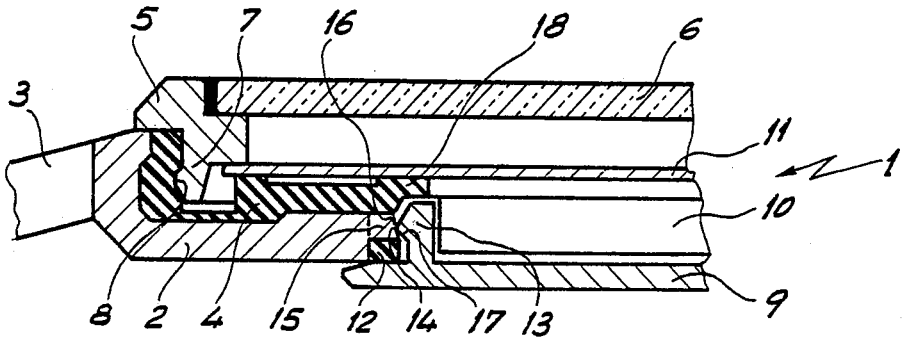
FIG. 1 is a partial view in section of a watch case according to a first embodiment of the invention.

As can best be seen in FIG. 1, the watch case 1 contains a middle 2, equipped, for example, with horns 3. The inner surface of the middle 2 is lined with a synthetic material 4. In the embodiment presented, a bezel 5, into which a crystal 6 is driven, is tightly mounted in an upper opening of the middle 2 by means of a peripheral skirt 7, presenting a projecting lip 8 which compresses and deforms the synthetic material 4 inside the middle 2. A back 9 is detachably mounted in an opening 30 provided at the bottom of the middle 2, e.g., for replacement of the battery of a movement 10 set in place by its upper opening and bearing a dial 11. According to the invention, the tightness of the watch case at its lower opening is achieved by means of a band of synthetic material 12 formed on the periphery of the lower opening 30 and which is compressed axially by virtue of the coupling of a surface 17 of a skirt 13 formed on the inner periphery of the back 9 with an inclined coupling surface 14 formed in the side walls 16 of the lower opening 30.

Passages 15 are provided in the middle to allow for the formation of the band 12 at the same time the lining 4 is formed. These passages 15 enable the synthetic material to flow when it is placed inside the middle toward the periphery of the lower opening in order to form a sealing band connected to the lining by portions of synthetic material crossing the passages 15.

Figure 3:
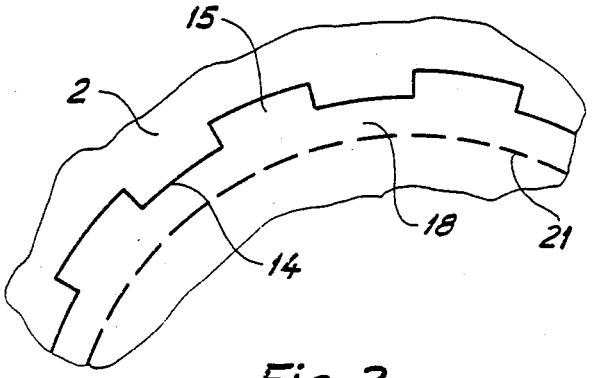
FIG. 3 is a partial top view of the middle of the watch case of FIGS. 1 and 2.

As can best be seen in FIG. 3, the passages 15 can consist of vertical grooves made in the side walls of the lower opening which are separated by unlined wall zones 14, on which the coupling of the peripheral skirt of the back will be exerted. The grooves 15 can be of roughly prismatic section, as represented, but also semicircular or of any other shape easy to machine. Furthermore, the lining 4 extends radially inward above the unlined wall zones 14 to form an elastic support 18 which laterally maintains the watch movement 10 and vertically maintains its dial 11. Furthermore, to limit the possibilities of displacement of the movement 10 inside the watch case, the dimensions of the skirt 13 are defined so as to leave only a small space of approximately 0.05 to 0.1 mm, between the opposite surfaces of the skirt and of the movement.

According to one particular process to manufacture the watch case represented in FIG. 1, the lining 4 which forms one piece with the band 12 due to the presence of the passages 15 is set in place according to a known process, e.g., molding. The coupling surface of the cone-shaped skirt 13 is then formed by simultaneously machining the synthetic material contained in the grooves 15 and the unlined zones 14. One major advantage of this solution is to make it possible to form the lining 4 when the side walls of the lower opening are still cylindrical, which allows passage through the opening of the case of the mold used for formation of the lining.

Figure 2:
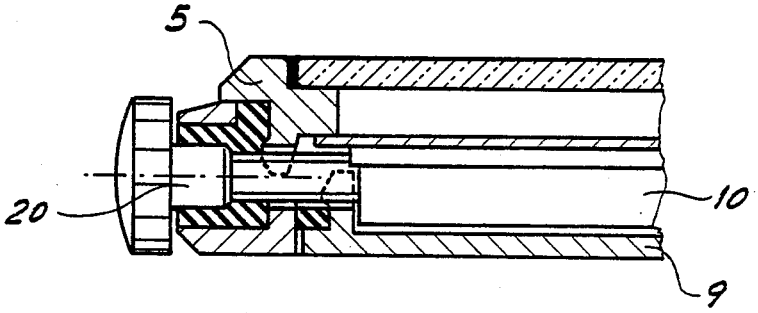
FIG. 2 is a partial sectional view showing the stem area of the watch case of FIG. 1.

In FIG. 2, the case of FIG. 1 is represented along a section passing through the axis of the control stem 20 of the movement. In order to show the passage of the latter, the corresponding parts of the skirt 7, of the bezel 5 and of the skirt 13 of the back are eliminated.

FIG. 3 represents a top view of a portion of the middle around the lower opening before the formation of the lining 4. The dotted line 21 represents the outer surface of the lining zone forming the projection 18. The grooves 15 could, of course, be replaced by holes of sufficient dimensions crossing the zone of the middle situated behind the coupling surface 14, in which case the latter would be continuous.

Figure 4:
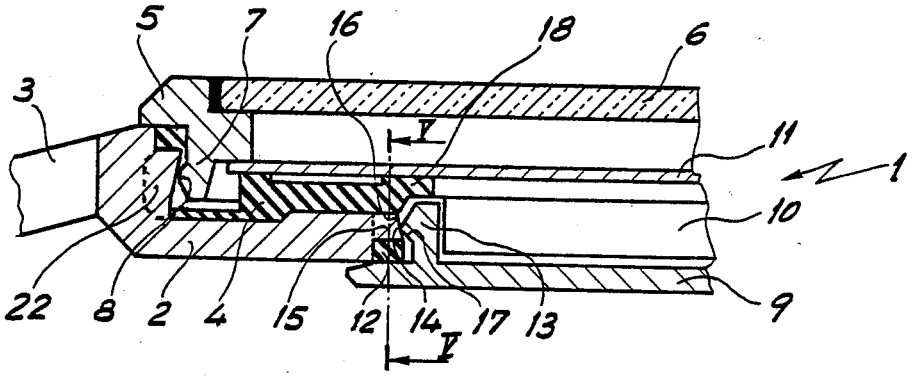
FIG. 4 is a partial view in section of a watch case according to a second embodiment of the invention.

The case represented in FIG. 4 differs from that of FIG. 2 by the fact that the skirt 7 of the bezel 5 as well as the skirt 13 of the back 9 bear on respective coupling surfaces 22 and 14 that the middle 2 contains.

Figure 5:
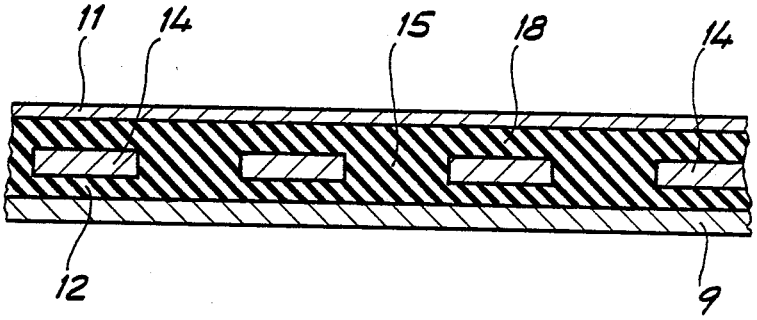
FIG. 5 is a sectional view taken along lines V—V of FIG. 4.

FIG. 5 is a sectional view taken along lines V—V of FIG. 4. This sectional view shows the dial 11, coupling surface 14, the elastic support 18 and the back 9. Band 12 is more clearly seen.

Although it has been described in relation to just two embodiments, the present invention is not at all limited thereto, but rather lends itself to numerous modifications and variations which will be evident to the expert.

What is claimed is:

1. A watch case comprising a middle containing a lining of synthetic material and at least one detachable part detachably mounted in an opening of the middle by means of a pressure device, wherein a band of synthetic material constituting a seal is formed on the periphery of the opening, the lining and the band being made in one piece and connected by portions of synthetic material crossing passages of the middle, the opening having side walls which are at least partially devoid of lining and form a coupling surface together with an opposite surface of the detachable part to assure pressure coupling of the detachable part and compression of the band of synthetic material, said passages comprising vertical grooves made in the side walls of the opening, said vertical grooves being separated by unlined wall zones.

2. A watch case according to claim 1, wherein the detachable part comprises a back of the watch case.

3. A watch case according to claim 1, further comprising a bezel connected to the top of the middle, said bezel bearing against said synthetic material.

4. A watch case according to claim 2, wherein the lining extends cantilevered radially inwardly above the unlined wall zones to form a lateral support for a watch movement placed in the case and a vertical support for its dial.

5. A watch case according to claim 2, wherein said back comprises a peripheral skirt, the dimensions of which leave only a slight space between the opposite surfaces of the skirt and of a watch movement placed in the case.

6. A watch case according to claim 1 wherein the material forming said lining inside the metal passes thereto through said opening, said material curing and forming said lining, the side walls of the opening then being machined to form said coupling surface while the synthetic material contained in the grooves and in the unlined zone is simultaneously machined to form said band.

* * * * *